United States Patent [19]

Park

[11] 4,157,951

[45] Jun. 12, 1979

[54] BENEFICIATION APPARATUS

[76] Inventor: Moon C. Park, 15 Talisay Rd., Forbes Park, Makati, Philippines

[21] Appl. No.: 849,117

[22] Filed: Nov. 7, 1977

[51] Int. Cl.[2] ..... B03B 5/02

[52] U.S. Cl. ..... 209/159; 366/165; 366/306

[58] Field of Search ..... 209/3, 17, 44, 168, 209/169, 160–163, 158–159, 172, 172.5, 173, 174, 178, 250, 254, 422, 463, 465; 210/221 M, 242 R; 261/87; 366/165, 306, 307

[56] References Cited

U.S. PATENT DOCUMENTS

| | | | |
|---|---|---|---|
| 1,172,634 | 2/1916 | Savage | 209/17 |
| 1,283,159 | 10/1918 | Groch | 209/169 |
| 2,104,349 | 1/1938 | MacCamy | 209/169 |
| 2,433,592 | 12/1947 | Booth | 209/168 |
| 2,758,714 | 8/1956 | Hollingsworth | 209/168 |
| 3,261,559 | 7/1966 | Yavorsky et al. | 209/17 |
| 3,972,815 | 8/1976 | O'Cheskey et al. | 210/221 M |

FOREIGN PATENT DOCUMENTS

| | | | |
|---|---|---|---|
| 96217 | 3/1924 | Austria | 209/169 |
| 539630 | 12/1931 | Fed. Rep. of Germany | 209/169 |
| 731287 | 6/1955 | United Kingdom | 209/158 |

*Primary Examiner*—Tim R. Miles
*Assistant Examiner*—Jon E. Hokanson
*Attorney, Agent, or Firm*—Fulwider, Patton, Rieber, Lee & Utecht

[57] ABSTRACT

Severed metal bearing ore is placed in a vessel having a water inlet at the bottom and an outlet at the top. A propeller causes water to flow upwardly through the vessel and to be discharged through the outlet carrying gangue with it. Concentrate, which is heavier because it contains the metal to be recovered, does not rise to the level of the outlet and therefore remains in the vessel. A member, which can be floated on the top surface of the water, inhibits turbulence and suppresses the formation of a vortex, thereby contributing to the formation of a calm water region at the top of the vessel for improved separation. Water turbulence can be further inhibited by a screen placed across the vessel between the propeller and the floating member.

16 Claims, 3 Drawing Figures

Fig. 1
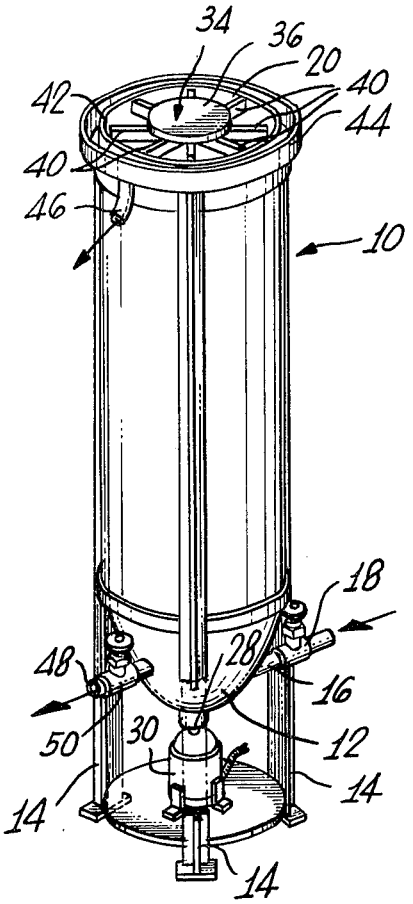
Fig. 2
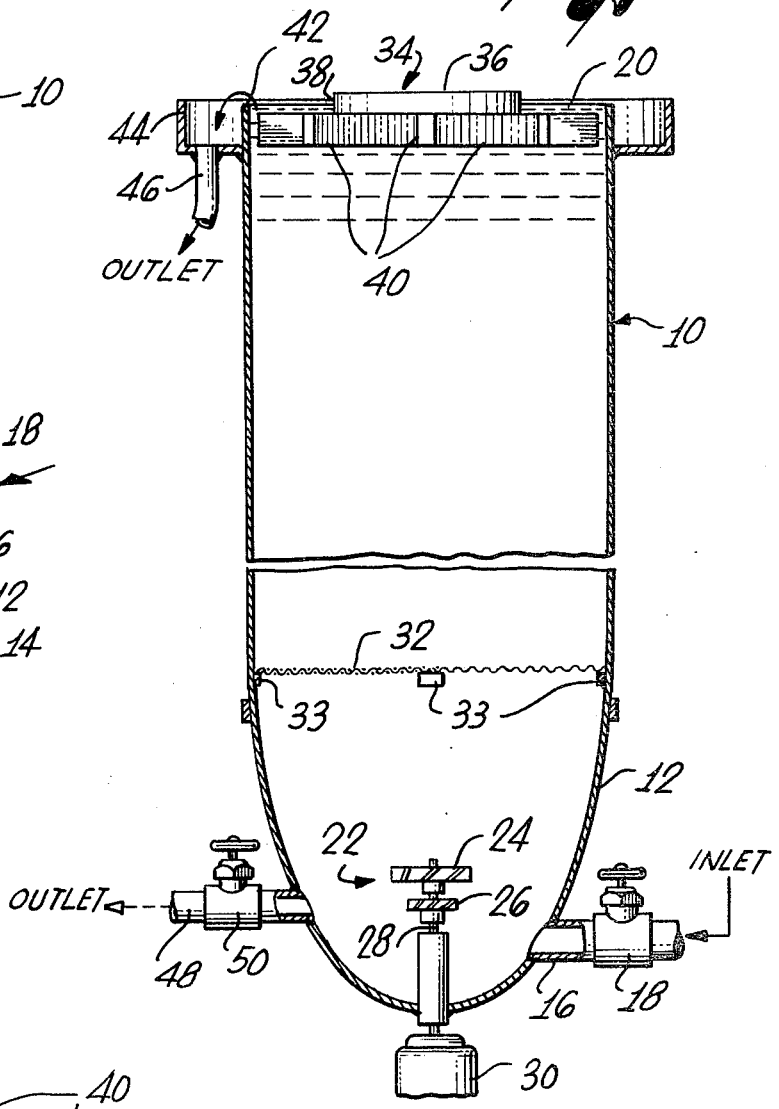
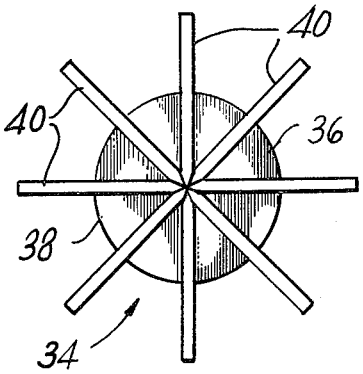
Fig. 3

BENEFICIATION APPARATUS

BACKGROUND OF THE INVENTION

This is a continuation-in-part of applicant's earlier application Ser. No. 721,988, filed Sept. 10, 1976 and entitled Beneficiation Apparatus and Method.

The present invention relates to a beneficiation apparatus, and particularly to such apparatus, in which the difference in the specific gravity of gangue and concentrate is utilized to achieve separation of severed ore.

Run-of-the-mine ore is usually too great in bulk and weight to permit shipping without initial processing at the mine to concentrate sought-after metals into a product of smaller bulk. The first step in conventional mine site processing is severance, in which the ore is comminuted by crushing, usually in several phases. The next step is beneficiation in which the severed ore is separated into concentrate, in which the metal is found, and gangue (also known as tailing), which is a waste product. The concentrate is then shipped to a refinery where pure metal is liberated by chemical or thermal means.

The profitability of a mine is often dependent upon the cost of beneficiation, and many mines that would yield low grade ore are not worked because of the high expense that this process would entail if known techniques were employed. Copper and precious metals, for instance, are often present in such low grade ore.

A common method of beneficiation used to recover such metals is called tabling. The severed ore is introduced onto a reciprocating deck which is continuously washed by a water film, the reciprocation of the deck being at right angles to the water flow. As the ore moves across the deck, the gangue and concentrate are stratified owing to the difference in their specific gravities, and the concentrate is trapped by rifles of successively increasing length raised on the surface of the deck.

Another known method of beneficiation applicable to severed metal ore is called sink-float separation. The ore is introduced into a suspension having a specific gravity higher than the gangue but lower than the metal. The suspension is stirred in a rotary fashion as it flows through a conically shaped vessel. The gangue tends to float across the top of the vessel and out the opposite side, while the concentrate sinks and is discharged through the pointed lower end of the vessel. In this, as in other beneficiation processes, the metal is not recovered in pure form nor is the gangue completely free of metal. The metal is, however, present in the concentration in a much higher proportion than in the beneficiated ore, and the proportion of metal found in the gangue should be very small.

Known beneficiation techniques are often time-consuming, labor intensive and costly. The principal objective of the present invention is to provide a new and different beneficiation apparatus capable of processing severed ore within a short period of time, using less labor, and at a greatly reduced cost.

SUMMARY OF THE INVENTION

The present invention is embodied in an apparatus by which severed ore is separated into gangue and concentrate. It relies on the difference in specific gravity between these two ore components, but in a manner completely different from previously known beneficiation techniques.

The apparatus employed is a generally upright vessel with a water inlet at the bottom and an outlet at the top. Severed ore is placed in the vessel and water is then forced to flow upwardly from the inlet to the outlet by the rotation of a propeller near the bottom of the vessel. The lighter gangue is carried upwardly by the flow and pressure of the water to the level of the outlet where it is discharged. The heavier metal, although propelled from the bottom of the vessel, does not rise to the level of the outlet and thus remains in the concentrate at the bottom.

Improved vertical separation of gangue and concentrate is attained by placing a turbulence inhibiting member across the vessel in contact with the top surface of the water. This member, which may be buoyant and floated on the water, thereby insuring that it is positioned at the correct height, encourages the formation of a zone of relatively quiescent water and inhibits the formation of a vortex. When the heavier particles reach this region of relatively weak current, they settle more rapidly toward the bottom of the vessel. Accordingly, the turbulence suppression member permits a substantially higher rate of throughput.

The suppression member may have a disk-shaped center portion with a plurality of radial positioning members. The water surface is contacted by the underside of the disk. Preferably, the vessel has an open top end that forms the outlet, thereby eliminating asymmetric currents since the water overflows the entire perimeter of the vessel, and the suppression member floats approximately at the level of the open end.

To further improve the vertical separation, a screen can be placed horizontally across the vessel between the propeller and the floating member, preferably one-third of the distance from the bottom of the vessel. The function of the screen is to equalize the water pressure and inhibit rotational flow in the portion of the vessel above the screen.

Other features and advantages of the present invention will become apparent from the following detailed description, taken in conjunction with the accompanying drawings, which illustrate, by way of example, the principles of the invention.

DESCRIPTION OF THE DRAWING

FIG. 1 is a partially broken-away perspective view of a beneficiation apparatus that embodies many novel aspects of the invention;

FIG. 2 is an enlarged, fragmentary, cross-sectional side view taken substantially through the middle of the apparatus of FIG. 1, the center section of the apparatus being partially broken away to reduce its height; and FIG. 3 is an enlarged cross-sectional bottom view of a suppression member that forms part of the apparatus.

DESCRIPTION OF THE PREFERRED EMBODIMENT

The beneficiation apparatus of the invention is used to separate concentrate from the gangue of severed ore to recover metals such as copper and precious metals. It is capable of economically processing large quantities of ore within a relatively short time period. The exemplary apparatus, illustrated in FIGS. 1 and 2 of the drawings, includes a vessel 10 that is generally cylindrical, having a vertical longitudinal axis and a lower end 12 that is elliptical in cross-section. The vessel 10 is supported in an upright position by a frame 14. A water inlet 16, which may be closed by a valve 18, is provided at the bottom 12 and the top end 20 of the vessel is open to form an outlet.

A propeller 22 is located within the vessel slightly above the inlet 16 to increase the water pressure at the bottom and to create an upward water flow. The propeller 22 includes two upper blades 24 rotatable about the central longitudinal axis of the vessel 10 and having a pitch such that they form an angle of about 15 to 22.5 degrees with the horizontal. Two lower propeller blades 26 positioned immediately below the upper blades and rotatable about the same axis have a length slightly greater than half that of the upper blades and a pitch such that they form an angle of about 30 degrees with the horizontal. The principal purpose of the lower propeller is to stir the water at the bottom of the vessel 10. The propeller 22 is driven via a shaft 28 by a variable speed motor 30 supported by the frame 14 beneath the lower end 12 of the vessel 10.

A removable, flat, wire mesh screen 32 is positionable horizontally across the vessel 10 between the propeller means 22 and the outlet 20 to influence the water flow, tending to create a relatively quiescent zone at the top of the vessel in a manner described more fully below. The preferred position of the screen 32 is at a level one-third of the distance from the bottom of the vessel 10 to the outlet 20, but the optimum position depends upon the characteristics of the ore and other parameters. The position of the screen 32 can be made adjustable for this reason. When in place, it is supported by inwardly projecting lugs 33 on the sides of the vessel 10. Preferably, the screen 32 is 4 to 8 mesh, but a finer mesh such as 20 or 30 can be used.

The swirling water flow attributable to the propeller 22 tends to form a vortex at the top of the vessel despite the beneficial effect of the screen 32. The vortex has a mixing effect that hinders the efficient separation of gangue from concentrate. As the propeller speed is increased, a more pronounced vortex is formed, and it is therefore necessary to limit the propeller speed if a high degree of separation is to be achieved. It has been found, however, that the vortical effect can be eliminated or greatly reduced by an imperforate turbulance suppression member 34 across the vessel 10 at approximately the level of the outlet 20, in contact with the top surface of the water. The presence of this suppression member 34 permits the propeller speed to be increased substantially, and the throughput can be increased accordingly.

The suppression member 34 is in the form of a disk-shaped center portion 36 presenting a flat underside 38 to the water. Eight elongated radial positioning members 40 extend horizontally from the middle of the center portion 36, being attached to its underside 38, although a larger number of positioning members may be used for added stability. The length of each positioning member 40 is such that the largest diameter of the suppression member 34 is slightly less than the inside diameter of the vessel 10.

The suppression member 34 is buoyant and therefore automatically positioned at the level of the water surface. It is made of wood or other suitable material having a density such that it floats with the positioning members 40 submerged and most of the center portion 36 riding above water.

The rising water is diverted outwardly past the center portion 36, upwardly between the positioning members 40 and over the top edge 42 of the vessel 10. It then falls into a collar 44 that surrounds the vessel 10, just below the top edge 42, and flows out through a drain 46. Since the water overflows the entire perimeter of the vessel 10, relatively fast moving or asymmetrical currents that would have a mixing effect are avoided.

The metal that is to be processed is typically found in only a minority of the severed ore particles. The objective in operating the apparatus described above is to separate the ore into gangue, which contains little or none of the metal, and concentrate, which includes the metal-bearing particles and therefore a much higher percentage of metal than the unbeneficiated ore.

The suppression member 34 and the screen 32 are removed and loose, granular, severed ore, the particle size of which should be uniform as possible, is placed in the bottom 12 of the vessel 10. The screen is then replaced and rotation of the propellers 24 and 26 is commenced. The effect of the rotating propellers is to produce a swirling upward flow of the water and to prevent the ore from settling in the bottom 12 of the vessel 10. Water is continuously supplied at a controlled rate to the vessel inlet 16 as it flows out through the outlet 20.

The water imparts an upward movement to the ore particles. Although this movement is imparted to all particles, those having a lower specific gravity tend to rise higher and faster. Thus, a vertical separation tends to occur between particles which contain significant quantities of metal and those which do not. As the rotation of the propellers continues, more and more of the lighter nonmetallic particles rise to a level of the outlet 20 and are carried away as gangue while the particles remaining in the vessel 10 form concentrate. Separation can be optimized by adjusting the rate of water flow and the propeller speed, although the optimum rate and speed depend upon the properties of the particular ore being processed, the dimensions of the vessel and the configuration of the propellers. Speeds between 200 and 1200 rpm have generally been found satisfactory, but speeds between 600 and 800 rpm are preferred. Within the preferred speed range, the optimum size of the center portion 36 of the suppression member 34 is about one-half the inside diameter of the vessel 10. A smaller disk is more suitable at lower propeller speeds.

The ore particles are given considerable momentum at the bottom of the vessel 10 in the vicinity of the propeller means 22, but the forces acting on them diminish as they move upwardly toward the outlet 20. The quiescence of the upper zone further contributes to vertical separation since the heavier metal bearing particles cannot continue to move upwardly toward the outlet under the diminishing force of the quieter water.

Once the separation process has been completed, the concentrate can be removed from the bottom of the vessel 10 through a lower outlet 48 at the bottom of the vessel 10 opposite the inlet 16 or through a door in the vessel. The lower outlet 48 is closed by a valve 50 while the gangue is being separated.

Typically, the weight of the concentrate recovered at the completion of the process is only about 20 to 25 percent or less that of the unbeneficiated severed ore but the concentrate contains 90 to 97 percent of the metal originally present in the severed ore. If desired, the process can be repeated, preferably in a smaller vessel where finer control and more uniform conditions can be maintained, to produce further concentration of the metal.

The apparatus of this invention may be of almost any size desired depending upon the quantities of ore to be processed. A large apparatus for use at a copper mine may be, for example, 12 to 15 feet in diameter to process more than 100 tons of severed ore per hour. On the other hand, it can be as small as a desk top device for use by assayers. Generally it is best to employ a vessel having a height approximately three times its diameter, although this proportionality may be varied. It is preferable to employ both the screen 32 and the suppression member 34, but the suppression member still has a markedly beneficial effect in the absence of the screen and can be used without it. In a taller vessel, the size of the disk-shaped center portion 36 of the suppression member 34 can be decreased.

The optimum size of the propellers in relation to the diameter of the vessel depends upon the characteristics of the ore to be processed, but their size is usually not critical because compensation can be made by varying the propeller speed. By way of example, however, satisfactory performance has been achieved in a vessel 33 inches in diameter using upper propellers 7 inches in diameter and lower propellers 4 inches in diameter.

In the smaller size range, it is desirable to make the cylindrical walls of the vessel 10 of transparent plastic so that the operator can view the effect on the ore as he adjusts the propeller speed. In the case of large installations, metal walled vessels will be found less expensive and more durable, and the optimum propeller speed can be determined best by experimentation.

The apparatus described above permits the beneficiation of severed ore with much greater efficiency than is possible when using previously known techniques. Accordingly, it will not only increase the efficiency of presently operating large mines, but may make possible the working of smaller mines and those that have low grade ore from which metal cannot be extracted economically using conventional techniques. In addition, the apparatus is simple and relatively inexpensive, and can be constructed in virtually any size desired.

While a particular form of the invention has been illustrated and described, it will also be apparent that various modifications can be made without departing from the spirit and scope of the invention.

I claim:

1. A beneficiation apparatus for separating severed ore into concentrate and gangue comprising a vessel, a water inlet at the bottom of the vessel, a water outlet opening at the top of the vessel, means for causing upward flow of water through the vessel from the inlet to the outlet opening, and a downwardly facing turbulence-suppression member approximately at the level of the outlet opening and having a bottom surface extending horizontally across a substantial center portion of the vessel and contacted by the top surface of the water, whereby gangue is propelled upwardly and discharged through the outlet opening while concentrate does not rise to the level of the outlet because of its higher specific gravity, the formation of a vortex within the vessel being inhibited by the turbulence-suppression member.

2. The apparatus of claim 1, wherein the vessel has an open top end that forms the outlet opening to permit overflow of water about its periphery, and an external collar surrounding the vessel in which the overflow is collected.

3. The apparatus of claim 2, wherein the vessel is generally cylindrical having a vertical longitudinal axis.

4. A beneficiation apparatus for separating severed ore into concentrate and gangue comprising a vessel, a water inlet at the bottom of the vessel, a water outlet opening at the top of the vessel, propeller means located within the vessel near the bottom for causing upward and rotational flow of water through the vessel from the inlet to the outlet opening, a screen disposed across the vessel between the propeller means and the outlet opening, and a downwardly facing turbulence-suppression member approximately at the level of the outlet opening and having an imperforate bottom surface extending horizontally across a substantial center portion of the vessel and contacted by the water, whereby gangue is propelled upwardly and discharged through the outlet opening but concentrate does not rise to the level of the outlet opening and thus remains in the vessel due to its higher specific gravity, a relatively quiescent zone being formed between the screen and the suppression member.

5. The apparatus of claim 4, wherein the vessel has an open top end that forms the outlet opening to permit overflow of water about its periphery, and an external collar surrounding the vessel in which the overflow is collected.

6. A beneficiation apparatus for separating severed ore into concentrate and gangue comprising:

a generally cylindrical vessel having a vertical longitudinal axis, a height approximately three times its diameter, and an open top end forming an outlet;

an external collar surrounding the top end of the vessel;

a drain in the collar;

a water inlet at the bottom of the vessel;

propeller means rotatable about the longitudinal axis of the vessel and located near the bottom of the vessel above the level of the inlet for causing upward and rotational flow of water from the inlet up through the vessel, over the open top end of the vessel, into the collar and through the drain;

a flat horizontal screen of about 4 to 30 mesh disposed across the vessel between the propeller means and the top end to equalize water pressure and to inhibit rotational flow of the water in the portion of the vessel above the screen; and a buoyant turbulence suppression member positioned on the top surface of the water in the vessel at approximately the level of the top and having a disk-shaped outer portion and a plurality of radial positioning members, the center portion having a flat bottom surface and a diameter equal to about half the inside diameter of the vessel, the suppression member inhibiting the formation of a vortex;

whereby gangue is propelled upwardly and discharged through the drain, but concentrate does not rise to the level of the outlet due to its higher specific gravity and therefore remains in the vessel.

7. A beneficiation apparatus for separating severed ore into concentrate and gangue comprising a vessel, a water inlet at the top of the vessel, a water outlet opening at the top of the vessel, means for causing upward flow of water through the vessel from the inlet to the outlet opening, and a buoyant turbulence-suppression member floatable on the water in the vessel and disposed across at least a portion of the vessel having a bottom surface contacted by the top surface of the water, whereby gangue is propelled upwardly and discharged through the outlet opening while concentrate does not rise to the level of the outlet because of its higher specific gravity, the formation of a vortex within the vessel being inhibited by the turbulence-suppression member.

8. The apparatus of claim 7, wherein the turbulence-suppression member includes a center portion defining said bottom surface and a plurality of positioning members extending horizontally beyond said bottom surface.

9. The apparatus of claim 7, wherein the turbulence-suppression member has a disk-shaped center portion with a flat horizontal underside that forms said bottom surface and a plurality of radial positioning members extending therefrom.

10. The apparatus of claim 7, wherein said portion of the vessel across which the turbulence-suppression member is disposed is at the center of the vessel.

11. The apparatus of claim 10, wherein the turbulence-suppression member includes a disk-shaped portion that provides said bottom surface.

12. A beneficiation apparatus for separating severed ore into concentrate and gangue comprising a vessel, a water inlet at the bottom of the vessel, a water outlet opening at the top of the vessel, propeller means located within the vessel near the bottom for causing upward and rotational flow of water through the vessel from the inlet to the outlet opening, a screen disposed across the vessel between the propeller means and the outlet opening, and a turbulence-suppression member that is buoyant and floatable on the water in the vessel disposed across the vessel approximately at the level of the outlet opening, whereby gangue is propelled upwardly and discharged through the outlet opening but concentrate does not rise to the level of the outlet opening and thus remains in the vessel due to its higher specific gravity, a relatively quiescent zone being formed between the screen and the suppression member.

13. The apparatus of claim 13, wherein the vessel has an open top end that forms the outlet opening to permit overflow of water about its periphery, and an external collar surrounding the vessel in which the overflow is collected.

14. The apparatus of claim 12, wherein the turbulence-suppression member includes a center portion defining said bottom surface and a plurality of positioning members extending horizontally beyond said bottom surface.

15. The apparatus of claim 12, wherein the turbulence-suppression member has a disk-shaped center portion with a flat horizontal underside that forms said bottom surface and a plurality of radial positioning members extending therefrom.

16. The apparatus of claim 15, wherein the vessel is generally cylindrical having a vertical longitudinal axis.

* * * * *

UNITED STATES PATENT AND TRADEMARK OFFICE

CERTIFICATE OF CORRECTION

PATENT NO. : 4,157,951
DATED : June 12, 1979
INVENTOR(S) : Moon C. Park

It is certified that error appears in the above-identified patent and that said Letters Patent are hereby corrected as shown below:

In colum 8, line 8 change "13" (second occurrence) to --12--.

Signed and Sealed this

*Thirteenth* Day of *January 1981*

[SEAL]

*Attest:*

*Attesting Officer*

SIDNEY A. DIAMOND

*Commissioner of Patents and Trademarks*